US005680949A

United States Patent [19]

Roesler

[11] Patent Number: 5,680,949

[45] Date of Patent: Oct. 28, 1997

[54] PACKAGING CONTAINER HAVING A CHANGEABLE LENGTH

[75] Inventor: Peter Roesler, Ifenweg, Germany

[73] Assignee: rose plastic GmbH, Hergensweiler, Germany

[21] Appl. No.: 399,354

[22] Filed: Mar. 3, 1995

[30] Foreign Application Priority Data

Mar. 3, 1994 [DE] Germany ..... 44 06 932.4

[51] Int. Cl.[6] ..... B65D 21/08

[52] U.S. Cl. ..... 220/8; 215/318

[58] Field of Search ..... 220/8, 212, 288, 220/289, 296, 298; 215/228, 43, 318; 285/176, 177, 382, 382.1, 382.2

[56] References Cited

U.S. PATENT DOCUMENTS

| | | | |
|---|---|---|---|
| 3,224,799 | 12/1965 | Blose et al. | 285/382.2 |
| 3,425,719 | 2/1969 | Burton | 285/382.2 |
| 4,046,279 | 9/1977 | Rosler | 220/8 |
| 4,210,253 | 7/1980 | Rosler | 220/8 |
| 4,245,753 | 1/1981 | Ellis | 220/296 X |
| 4,333,672 | 6/1982 | Arthur et al. | 285/382.2 |
| 4,509,656 | 4/1985 | Rosler | 220/8 |
| 4,596,340 | 6/1986 | Luther | 220/8 |

FOREIGN PATENT DOCUMENTS

| | | | |
|---|---|---|---|
| 1168602 | 12/1958 | France | 285/382.2 |
| 2523550 | 9/1983 | France | 215/43 |
| 2672271 | 8/1992 | France | 220/296 |
| 3325033 | 12/1986 | Germany . | |
| 2024163 | 1/1980 | United Kingdom . | |
| 94/24008 | 10/1994 | WIPO | 220/8 |

*Primary Examiner*—Allan N. Shoap
*Assistant Examiner*—Nathan Newhouse
*Attorney, Agent, or Firm*—Spencer & Frank

[57] ABSTRACT

A packaging container assembly having a variable length. The assembly includes an outer hollow body and an inner hollow body. The hollow bodies can be assembled with one another by a sliding of an open end of the inner hollow body into an open end of the outer hollow body for forming the packaging container assembly. Each hollow body has a rectangular cross section in a plane perpendicular to a longitudinal axis thereof thereby defining a plurality of longitudinal edges thereon. A plurality of rows of notches include a first set of rows of notches disposed on one of the hollow bodies, the rows of notches of the first set being disposed diagonally opposite one another on corresponding longitudinal edges of the one of the hollow bodies; and a second set of rows of notches disposed on another one of the hollow bodies, the rows of notches of the second set being disposed on all longitudinal edges of the other one of the hollow bodies. The first set and the second set of rows of notches are configured to latchingly engage one another for securely latching the hollow bodies to one another upon a pushing together of the hollow bodies, the first set and the second set of rows of notches further being configured and disposed for allowing a separation of the hollow bodies from one another only upon a twisting of the hollow bodies counter to one another about a longitudinal axis of the packaging container assembly formed therewith.

14 Claims, 4 Drawing Sheets

PACKAGING CONTAINER HAVING A CHANGEABLE LENGTH

CROSS REFERENCE TO RELATED APPLICATION

This application claims the priority of Application P 4406932.4 filed in Germany on Mar. 3, 1994, the rights of priority of which are claimed in the present application and the subject matter of which is incorporated herein by reference.

FIELD OF THE INVENTION

The invention relates to a packaging container having a changeable length, and intended preferably for packaging long stretched out objects, which container incorporates two hollow bodies having approximately the same sectional shape. Each hollow is closed on one face and open on the opposite face, the hollow bodies being connectible with one another by being slid into one another, and the packaging container having a latch arrangement.

BACKGROUND OF THE INVENTION

A packaging container of the above type is shown in DE 33 25 033 C2 based on an invention of the inventor of the present invention. In such packaging containers, approximately rectangular hollow bodies can be slid into one other. Latching protuberances are provided in the corner regions of the interlocking parts, the latching protuberances engaging associated latching recesses in the part which lies opposite thereto.

The drawback of the above-described packaging container is that the hollow bodies are not fastened to one another securely enough to prevent them from opening and separating under a pulling action. The above means that, if the packaging container is loaded with a heavy article and is, for example, hung in the direction of its longitudinal axis, it is possible, based on the weight of the loaded one of the hollow bodies, for the latter to unintendedly slide out of the other associated hollow body.

To open the packaging, a pulling force is thus exerted on one of the hollow bodies, while the other hollow body is held in place. It has become apparent that opening the packaging is possible only if the inner hollow body of the packaging deforms slightly in radially inward direction in order to even make possible a loosening of the latch connection between the two hollow bodies.

However, the radial inwardly directed deformation of the inner hollow body presents the drawback that such a deformation does not succeed if the inner hollow body is filled with an object such that this object fills out the entire cross section of the hollow body so that the latter can no longer sufficiently deform in radially inward direction. In that event, the packaging can be loosened or opened only under more difficult conditions.

SUMMARY OF THE INVENTION

It is the object of the present invention to further develop a packaging container of the above type so that various objects, including heavy objects, can be stored securely in the packaging container without the risk of inadvertently opening the same.

With the above object in view, the present invention resides in a packaging container of the above type in which the two hollow bodies are securely latched together by way of the latching arrangement when the two bodies are pushed together and are separatable from one another only by twisting the two hollow bodies counter to one another and about the longitudinal axis of the packaging container.

The essential characteristic of the invention is that, in the load region of the two hollow bodies, latching notches are provided in respective edges of each hollow body, with the edges interlocking in a barbed fashion and preventing with certainty a pulling apart of the hollow bodies counter to this interlocking.

The above accomplishes the essential advantage that the two hollow bodies of the packaging can now no longer be pulled apart under load, because the interlocking latching notches are configured in a barbed fashion so as to prevent an inadvertent a pulling apart under all circumstances.

The above brings about the advantage that the two hollow bodies can no longer become unintentionally separated from one another under load in the direction of the longitudinal axis of the packaging container, because the same is avoided by the latch connections previously described.

According to the invention, the two hollow bodies are opened, i.e., pulled apart, not by overcoming a latching force of a latch connection as is described in the prior art, but by disengaging the latching notches, which are respectively arranged in rows of notches, by twisting one hollow body with respect to the other associated hollow body so that the latching notches of one row of notches of the one hollow body come to rest on a smooth non-interlocked surface of the hollow body which lies opposite thereto and, in this manner, a latching effect no longer exists so that the two hollow bodies can be pulled apart easily.

Accordingly, the latching direction is separate from the opening direction. The latching of the two hollow bodies still takes place in the manner of a closing motion in the direction of the longitudinal axis of the packaging container, while the opening motion now takes place via a twisting of the two hollow bodies with respect to one another. Thus, the direction of the latching motion is different from the direction of the opening motion in that the two directions are perpendicular to one another. In DE 33 25 033 C2 mentioned above, the two motions were executed in one direction which resulted in the disadvantage described above, namely, that the latch connection could not be secured to prevent renewed disengagement.

Thus, according to the invention, the latching direction and the opening motion are distinct from one another.

There are a number of different embodiments for the configuration of the latch between the two hollow bodies that are intended to be included in the present inventive idea.

Thus, in a first embodiment, latching notches are provided on diagonally opposite edges of the one hollow body which can be brought into engagement with latching notches disposed diagonally opposite thereto on the associated hollow body.

Preferably one hollow body has rows of notches which lie diagonally opposite each other, while on the other hollow body, corresponding rows of notches are provided on all four edges. This has the advantage that the two hollow bodies can be slid into one another irrespective of the location of the rows of notches.

In order to facilitate a turning motion between the interlocking parts of the packaging, the inner hollow body includes an interlocking portion and an outer portion. The interlocking portion preferably has a cross section comparable to the cross section of the outer portion. The corners of the cross section of the interlocking portion are preferably rounded and have radii larger than the associated radii in the corresponding corners of the outer portion of the inner hollow body.

The above facilitates a twisting of the inner hollow body in the surrounding outer hollow body, with it being possible to disengage the interlocking rows of notches of the inner and outer hollow body by twisting.

Moreover, the distinctness between the direction of the latching motion and the direction of the opening motion according to the invention also offers the further advantage that the radially inwardly directed deformation of the inner hollow body is now no longer essential. On the contrary, according to the invention, the inner hollow body deforms the outer hollow body in the overload region in radially outward direction so as to disengage the rows of notches associated with one another of the inner and outer hollow body.

The above avoids the drawback of the prior art which precluded the possibility of form-fittingly filling the inner hollow body with an article, as was the case in the mentioned DE 33 25 033 C2. Thus, a radially inwardly directed deformation of the inner hollow body is no longer essential in the invention, because, in contrast, according to the invention, the outer hollow body is deformed by the inner one. The packaging container can thus be form-fittingly filled by a heavy article while an easy opening of the packaging container is still ensured.

The two hollow bodies are preferably made of a plastic material, though other materials having a resilience that is comparable to plastic can also be used.

DETAILED DESCRIPTION OF THE PREFERRED EMBODIMENTS

Figure 1:
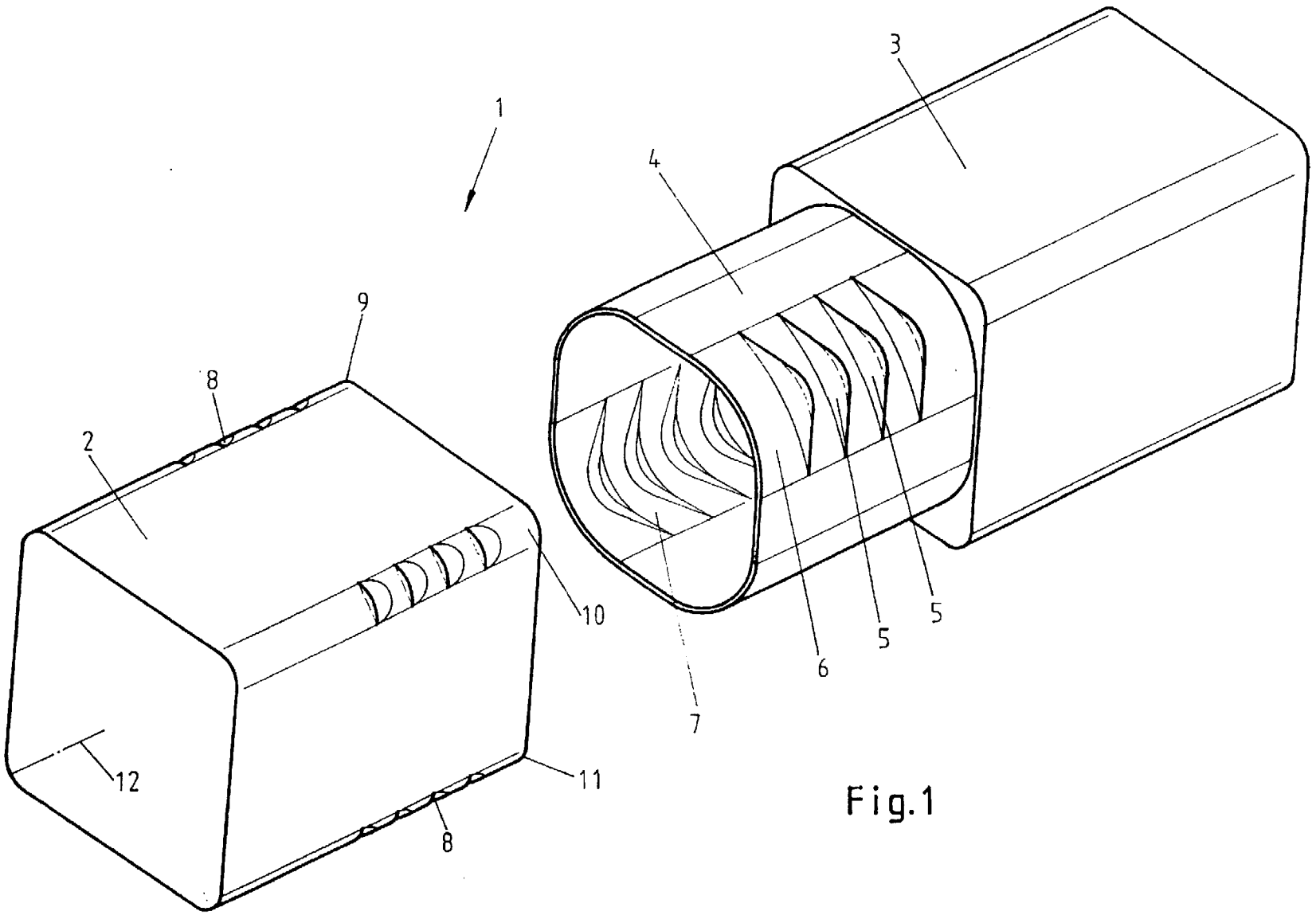
FIG. 1 shows a packaging container according to the invention in the pulled-out condition.

The packaging container according to FIG. 1 includes two hollow bodies 2, 3 adapted to receive oblong objects in their interior space. With regard to the further advantages of this packaging container, reference is made to the disclosure in the mentioned German patent. An important feature of the packaging container is the fact that objects of different length can be packaged, because, as shown in FIG. 1, in the overlapping region, a shoulder 4 of the inner hollow body 3 having a variable length plunges into the interior space of the associated outer hollow body 2 and can be latched with the latter.

In the illustrated embodiment, the latching takes place in that rows of notches 6, 7, which lie diagonally opposite each other, are provided at the longitudinal edges or corners on the shoulder 4, the rows being provided with corresponding latching notches 5.

On the opposite side, the hollow body 2 is provided, preferably on all four edges thereof, with respective rows of notches 9–12 which are provided with associated latching notches 8.

Figure 2:
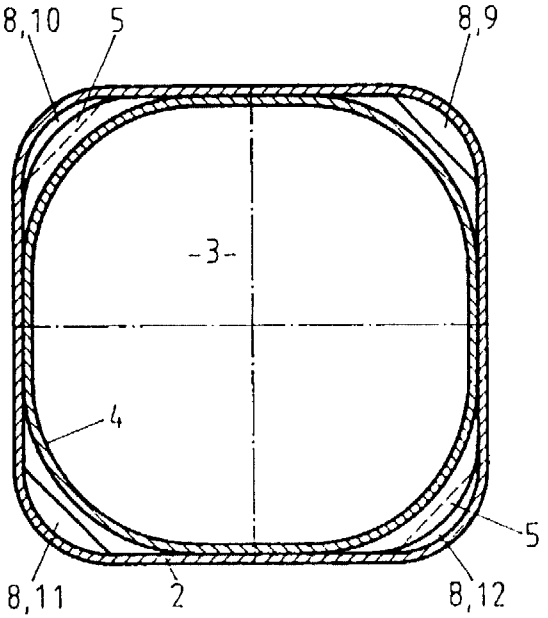
FIG. 2 shows a cross section through the overlapping region of the packaging container in the closed condition.
Figure 4:
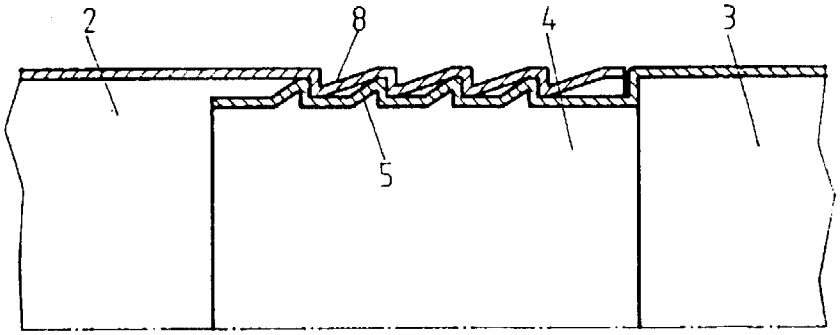
FIG. 4 shows a longitudinal cross section through one edge of the packaging container in the overlapping region in the closed condition.
Figure 5:
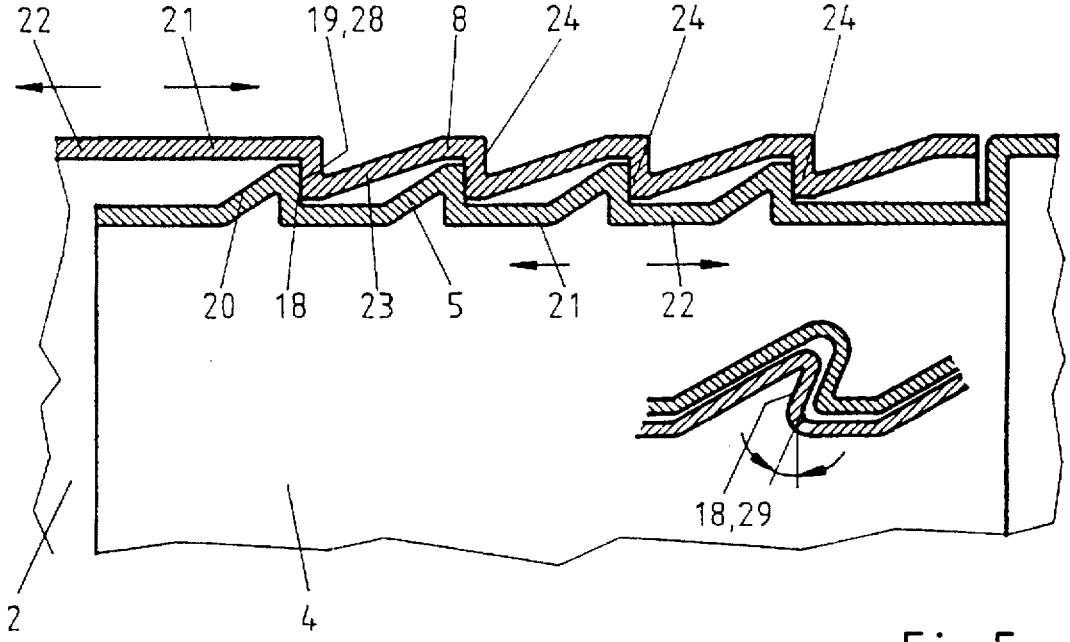
FIG. 5 shows an enlarged illustration of FIG. 4.

In the closed condition, the latching notches 5 thus engage the associated latching notches 8 and form barb-like latchings, as is explained in greater detail by way of the FIGS. 2, 4 and 5.

Figure 3:
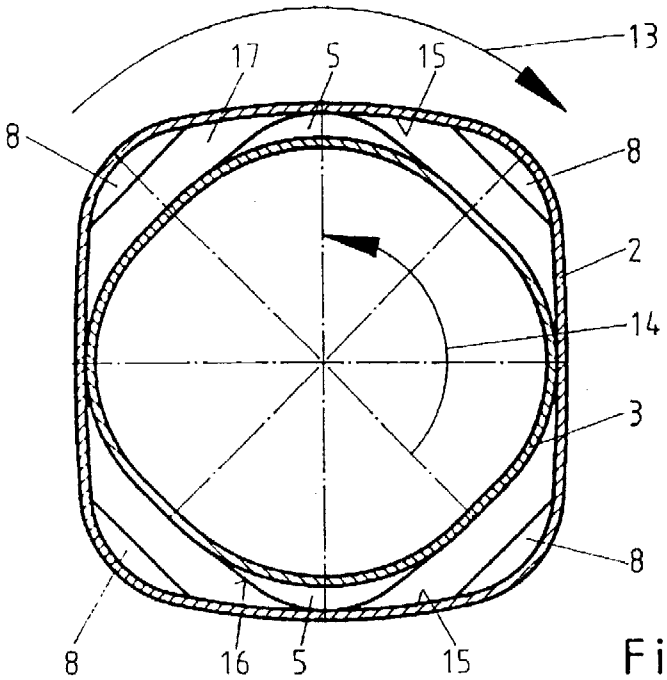
FIG. 3 shows a cross section similar to the one shown in FIG. 2 in the opening stage.

To open, the hollow bodies 2, 3 are twisted counter to one another in the directions of arrows 13, 14, with it being evident according to FIG. 3 that the latching notches 5 of the inner hollow body 3 become disengaged from the latching notches 8 directed diagonally inward, while the outer surfaces 16 of the latching notches 5 simultaneously deform the inner surface 15 of the hollow body 2 in radial outward direction so that the latching notches 5 come to rest against the smooth inner surfaces on the interior periphery of the hollow body 2 and thus the two bodies can be separated in the direction of the arrow 22 (FIG. 5).

In the closed condition, the latching notches 5, 8 are secured through a barb-like engagement with respect to one another to prevent opening in the direction of the arrow 22, while the latching notches on shoulder 4 create a non-interlocked free space 17 for themselves in hollow body 2 for opening so as to be able to separate the two hollow bodies 2, 3 from one another in the direction of arrow 22.

Here, the closing in the direction of arrow 21 takes place by sliding the two hollow bodies 2, 3 into one another in a non-twisted manner, with the latching notches 5, 8 engaging one another corresponding to the length of the overlap in the overlap region.

FIG. 4 shows a barb-like closure of the latching notches 5, 8 which are thus secured to prevent opening in the direction of arrow 22.

In this process, it can be seen in FIG. 5 that a relatively steep notch flank 18 on the inner hollow body, which may also be configured as an undercut—to provide an even stronger safeguard against unintended opening in the direction of arrow 22—cooperates with associated, steep notch flanks 19 on the outer hollow body which lies opposite.

The steep notch flanks 18, 19 respectively transition to associated less steep slopes 20, 23, respectively, so as to enable the latching notches 5, 8 to slide in the direction of arrow 21.

According to FIG. 5, a number of latch connections 24, which are arranged one behind the other, are thus created, which, in the embodiment illustrated, consist of latching notches 5, 8 engaging one another in a serrated fashion.

Figure 6:
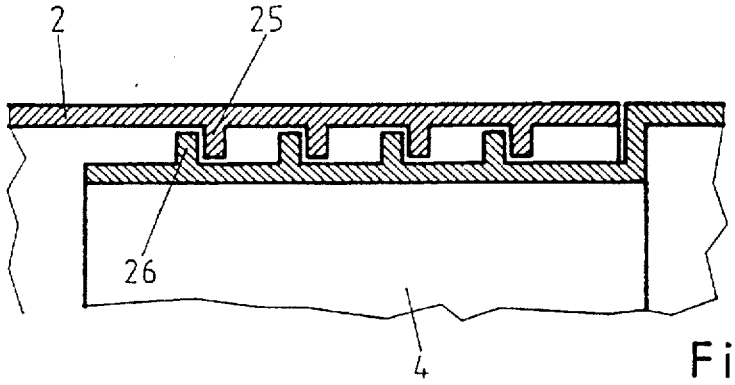
FIG. 6 shows a modified embodiment of the latch connection of FIG. 5.

A different form of latching notches 25, 26 is proposed in the embodiment according to FIG. 6, with the latching notches being profiled approximately rectangularly and also providing a latch connection that is secured against unintended opening in the direction of arrow 22.

Figure 7:
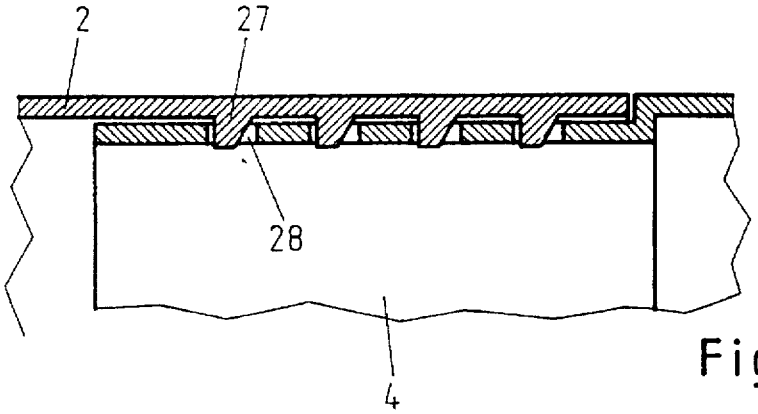
FIG. 7 shows a further modification of the latch connection of FIG. 5.

According to FIG. 7, a further embodiment provides that latching notches 27 that are profiled approximately trapezoidally engage associated latching recesses 28 on the hollow body which lies opposite.

In all embodiments, the notch flanks 18 and 19 as well as the latching notches 27 can be provided with corresponding undercuts 29 in order to ensure an even better safeguard against unintended opening in the direction of arrow 22.

Also, in all embodiments illustrated, the parts may be kinematically reversed, i.e., on the embodiment of FIG. 7, the latching recesses 28 can be provided, in the outer hollow body 2 while on the inner hollow body 4 radially outwardly directed latching notches 27 can be provided which engage the latching recesses 28.

Likewise, the latching notches 18, 19 may be formed by the deformation of the material of the hollow body 2, 3, itself or—as is illustrated in FIGS. 6, 7—they may be formed on the smooth walls of the hollow bodies.

Figure 8:
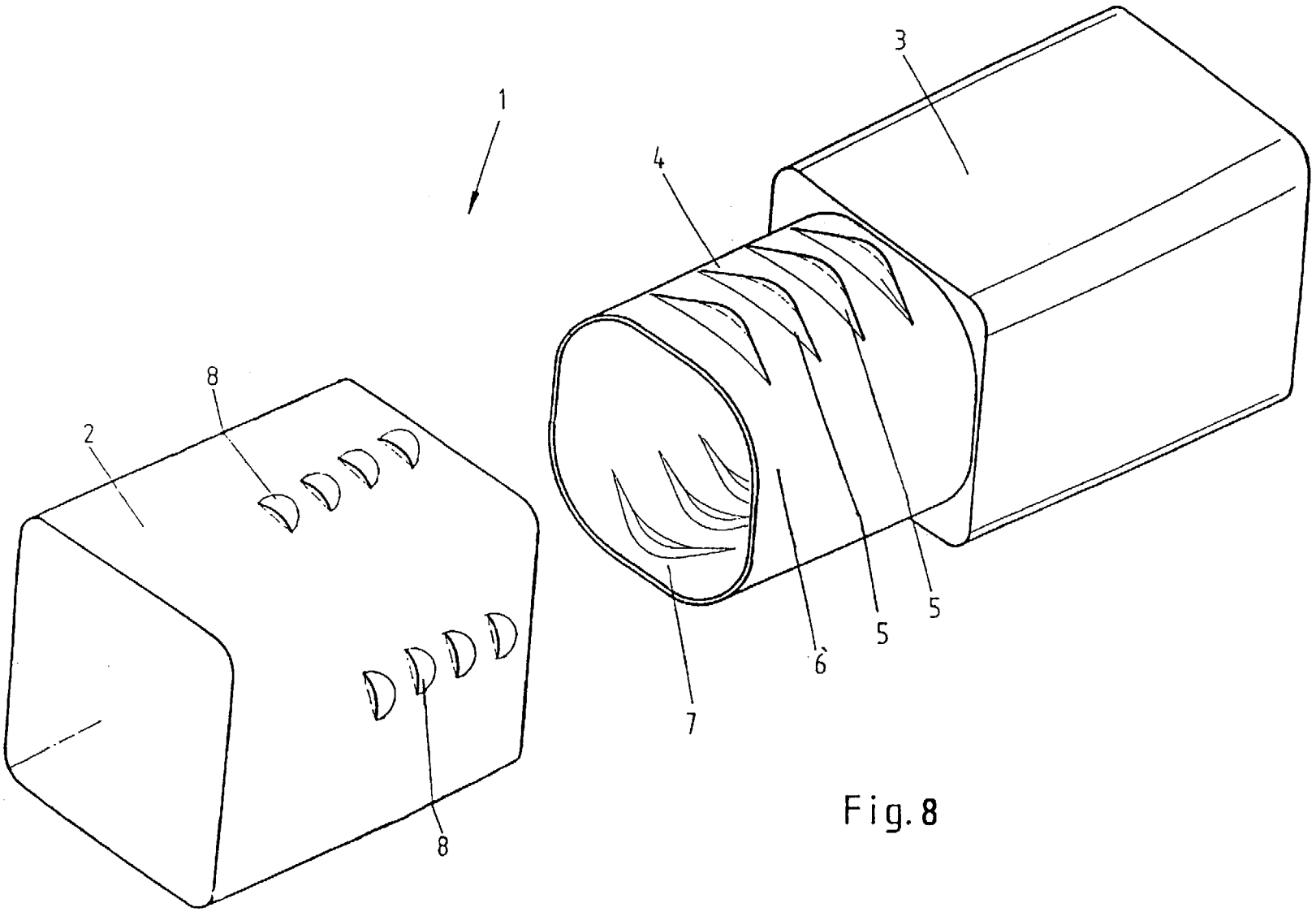
FIG. 8 shows a modified embodiment of the packaging container with the rows of notches being located in the middle region of the side faces of the hollow bodies.

Also, shown in FIG. 8, the rows of notches 6, 7 need not be arranged in the edge region of the hollow body 2 but may be outside of this edge region, parallel to these longitudinal edges. In this case, the rows of notches, are arranged approximately in the middle region of the hollow body 2, and they may also arranged opposite of one another.

It will be understood that the above description of the present invention is susceptible to various modifications, changes and adaptions, and the same are intended to be comprehended within the meaning and range of equivalents of the appended claims.

What is claimed is:

1. A set of components for forming a packaging container assembly having a variable length, the set comprising:

an outer hollow body and an inner hollow body, each hollow body having an open end and a closed end, the hollow bodies being configured to be assembled with one another by a sliding of the open end of the inner hollow body into the open end of the outer hollow body for forming the packaging container assembly, each hollow body further having a rectangular cross section in a plane perpendicular to a longitudinal axis thereof thereby defining a plurality of longitudinal corners thereon; and a plurality of rows of notches including:

a first set of rows of notches disposed on one of the hollow bodies, the rows of notches of the first set being disposed diagonally opposite one another on corresponding longitudinal corners of the one of the hollow bodies; and a second set of rows of notches disposed on the other one of the hollow bodies, the rows of notches of the second set being disposed on all longitudinal corners of the other one of the hollow bodies, the first set of rows of notches and the second set of rows of notches being configured to latchingly engage one another for securely latching the hollow bodies to one another upon a pushing together of the hollow bodies, the first set of rows of notches and the second set of rows of notches further being configured and disposed for allowing a separation of the hollow bodies from one another only upon a twisting of the hollow bodies counter to one another about the longitudinal axis of the packaging container assembly formed therewith.

2. The set according to claim 1, wherein the notches are configured such that, in an assembled state, the first set of rows of notches and the second set of rows of notches interlock in a barb-like fashion for counteracting a pulling apart of the hollow bodies.

3. The set according to claim 1, wherein:

one of the first set of rows of notches and the second set of rows of notches is disposed on an outer surface of the inner hollow body;

the other one of the first set of rows of notches and the second set of rows of notches is disposed on an inner surface of the outer hollow body such that, upon a twisting of the hollow bodies counter to one another for separating the hollow bodies from one another, the rows of notches on the outer surface of the inner hollow body run on a smooth portion of the inner surface of the outer hollow body to allow the hollow bodies to be pulled apart.

4. The set according to claim 3, wherein the rows of notches on the outer surface of the inner hollow body are configured to deform the inner surface of the outer hollow body radially outwardly upon a twisting of the hollow bodies counter to one another.

5. The set according to claim 1, wherein the notches have a serrated configuration.

6. The set according to claim 1, wherein the notches comprise steep-walled notch flanks and flat slopes adjoining the notch flanks, the notch flanks transitioning into the flat slopes.

7. The set according to claim 6, wherein the notch flanks include undercuts.

8. The set according to claim 1, wherein the notches have a rectangular configuration.

9. The set according to claim 1, wherein:

the notches on one of the hollow bodies have a trapezoidal configuration; and the notches on the other one of the hollow bodies define recesses configured to be engaged by the notches of the one of the hollow bodies.

10. The set according to claim 1, wherein:

each hollow body has walls; and the notches are deformations of the walls of each hollow body.

11. The set according to claim 1, wherein:

each hollow body has walls; and the notches are formations disposed on the walls of each hollow body.

12. The set according to claim 1, wherein the longitudinal corners on each hollow body are rounded and thereby define a rounding radius.

13. The set according to claim 12, wherein the rounding radius of the longitudinal corners of the inner hollow body is larger than the rounding radius of the longitudinal corners of the outer hollow body.

14. The set according to claim 1, wherein some of the rows of notches are disposed in a middle region of side faces of the hollow bodies.

* * * * *

UNITED STATES PATENT AND TRADEMARK OFFICE

CERTIFICATE OF CORRECTION

PATENT NO. : 5,680,949
DATED : October 28, 1997
INVENTOR(S) : Peter Roesler

It is certified that error appears in the above-indentified patent and that said Letters Patent is hereby corrected as shown below:

On the title page, item [75], the inventor's city of residence should read --Wangen--.

Signed and Sealed this

Third Day of February, 1998

*Attest:*

*Attesting Officer*

BRUCE LEHMAN

*Commissioner of Patents and Trademarks*